United States Patent [19]

Sano

[11] 4,392,442

[45] Jul. 12, 1983

[54] SEWING MACHINE WITH A CYCLIC PATTERN STITCHING DEVICE

[75] Inventor: Yasuro Sano, Hachioji, Japan

[73] Assignee: Janome Sewing Machine Co., Ltd., Tokyo, Japan

[21] Appl. No.: 230,593

[22] Filed: Feb. 2, 1981

[30] Foreign Application Priority Data

Feb. 6, 1980 [JP] Japan ..... 55/12812

[51] Int. Cl.[3] ..... D05B 69/22; D05B 3/02

[52] U.S. Cl. ..... 112/275; 112/158 A

[58] Field of Search ..... 112/275, 274, 277, 158 A, 112/158 D, 158 B

[56] References Cited

U.S. PATENT DOCUMENTS 3,455,259 7/1969 Wenz et al. ..... 112/275

4,331,092 5/1982 Hisatake ..... 112/275

FOREIGN PATENT DOCUMENTS 2909664 9/1979 Fed. Rep. of Germany ..... 112/275

*Primary Examiner*—Peter P. Nerbun

*Attorney, Agent, or Firm*—Michael J. Striker

[57] ABSTRACT

The invention relates to a sewing machine and more particularly relates to a cyclic pattern stitching device of a sewing machine which is automatically stopped with the needle detained at a predetermined position when a pattern is stitched up in accordance to one cycle rotation of a selected pattern cam.

1 Claim, 10 Drawing Figures

SEWING MACHINE WITH A CYCLIC PATTERN STITCHING DEVICE

BACKGROUND OF THE INVENTION

In a conventional pattern stitching sewing machine employing pattern cams rotated at a reduced speed by the drive shaft of the sewing machine, the initial stitch of a pattern is produced at random in dependence upon the angular position of a pattern cam at which the cam is stopped when the sewing machine is at standstill, and it is almost impossible to expect that the selected pattern is produced from the initial starting point of the pattern cam. This is inconvenient in case the same patterns or different patterns are produced in sequence. In case of stitching such a combination of patterns, it is desirable that the sewing machine is started from the initial stitch coordinate of the pattern determined by the pattern cam and automatically stops at the last stitch coordinate of the pattern determined by the pattern cam for the purpose of stitching the next pattern from the initial stitch coordinate thereof. With the conventional pattern stitching sewing machine, it is very difficult and almost impossible to do such a pattern stitching operation, except by manipulation of the machine operator stopping and starting the sewing machine at a desired stitch coordinates of the pattern.

The invention has been provided to eliminate such defects and disadvantages of the prior art, and it is a primary object of the invention to provide a sewing machine cyclically stitching patterns in sequence in accordance to pattern cams from a predetermined initial stitch coordinate to a predetermined last stitch coordinate of each pattern.

It is another object of the invention to automatically stop the sewing machine with the needle detained at a predetermined position after one complete stitching cycle of a pattern cam.

The other features and advantages of the invention will be apparent from the following description of a preferred embodiment in reference to the attached drawings.

DESCRIPTION OF A PREFERRED EMBODIMENT

Figure 1:
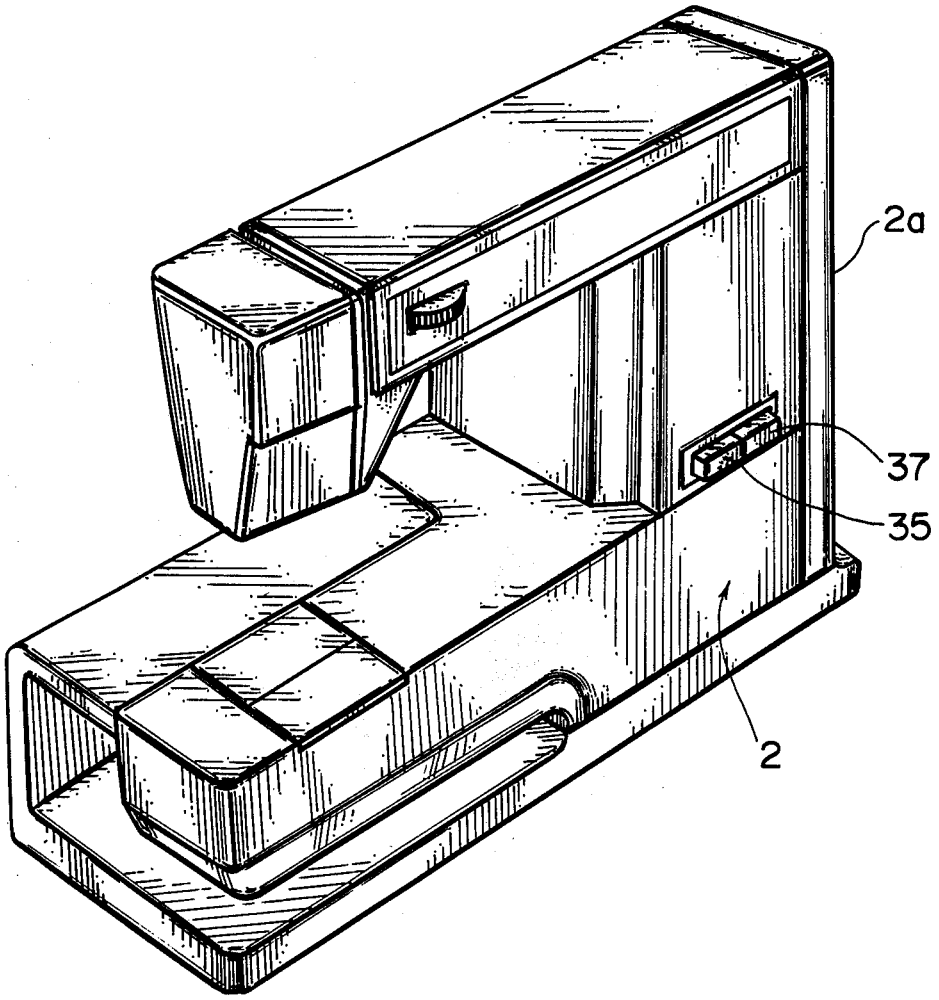
FIG. 1 is a perspective view of a sewing machine according to the invention.
Figure 2:
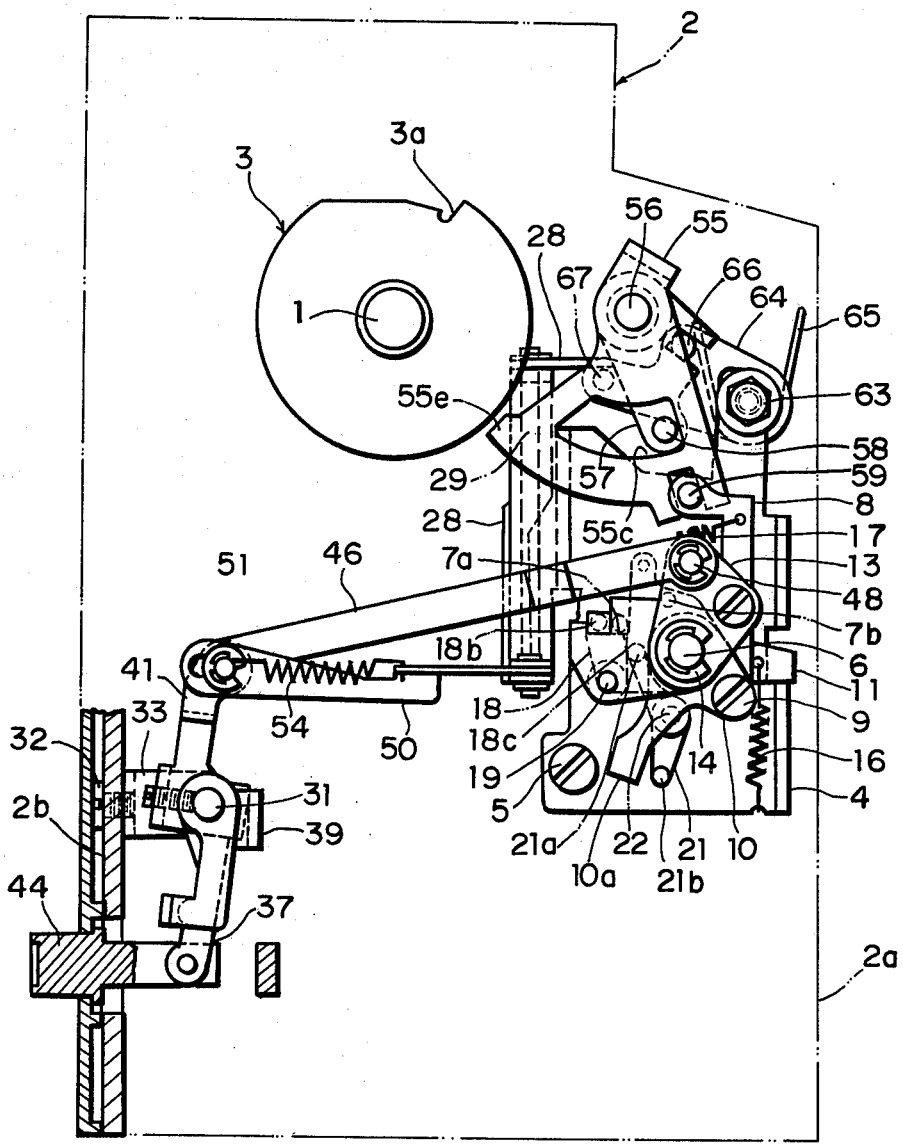
FIG. 2 is a side elevational view of the invention taken from the right side of FIG. 1, with the housing indicated in dash-dot lines.

With reference to FIGS. 1 and 2, an upper drive shaft 1 is rotatably mounted on a housing 2 of the sewing machine, and has a stop cam 3 mounted thereon for rotation therewith through a clutch which is not an object of the invention and is not shown. The stop cam 3 is formed with an abutment 3*a* which is to be engaged by a pawl 55*e* of stop member 55 as will be mentioned herein later. A bracket 4 is secured to the housing 2*a* by a fastening screw 5 within the sewing machine, and has a laterally extended support pin 6 secured to one side thereof.

Figure 4:
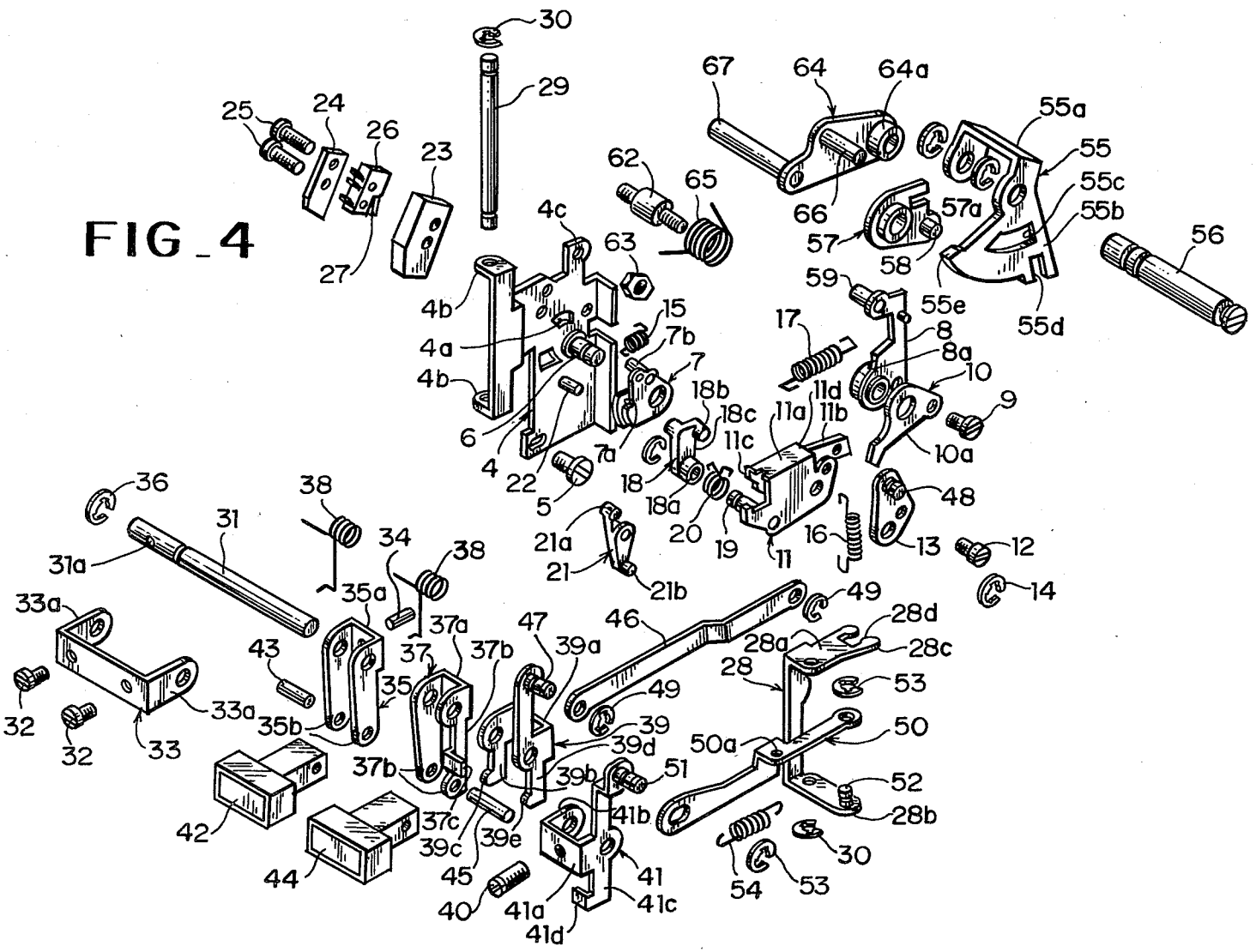
FIG. 4 is an exploded view of the mechanism of the invention.

As shown in FIG. 4, a switch operating plate 7, a releasing lever 8, an adjusting plate 10, a stop lever 11 and a stop plate 13 are turnably mounted on the support pin 6 in this order, and prevented from axial displacement by a snap ring 14 secured to the end of the pin 6. As shown, the adjusting plate 10 is connected to the releasing lever 8 by a screw 9, and the stop plate 13 is connected to the stop lever 11 by a screw 12. The switch operating plate 7 and the stop lever 11 are biased in the clockwise direction by springs 15, 16 respectively.

A spring 17 has one end engaged to a shoulder 11*c* of the stop lever 11, and another end engaged to the releasing lever 8 to normally press the part 8*a* of the releasing lever 8 to another shoulder 11*d* of stop lever 11. An operating pawl 18 is at the boss 18*a* turnably mounted on a pin 19 of the stop lever 11, and is biased in the clockwise direction by a torsion spring 20. Thus the operating pawl 18 is with its lateral projection 18*b* pressed against the shoulder 11*c* of the stop lever 11 and against a step 7*a* of the switch operating plate 7. A releasing pawl 21 is at an intermediate part thereof turnably mounted on a laterally extended pin 22 of the bracket 4, and has an upper end 21*a* which is to act on a part 18*c* of the operating pawl 18 and a lower end 21*b* which is to be contacted by a leg 10*a* of the adjusting plate 10.

A switch case 23 is secured to the bracket 4 on the other side thereof together with a cover 24 by fastening screws 25, and a microswitch 26 with an actuator 27 is positioned in the switch case 23. As shown, the bracket 4 is formed with a laterally elongaged slot 4*a* through which a laterally extended projection 7*b* of the switch operating plate 7 is passed to the other side of the bracket 4 to act on the actuator 27 of the miroswitch 26.

A frame 28 having an upper arm 28*a* and a lower arm 28*b* is turnably mounted around a vertical shaft 29 which is inserted into upper and lower holes 4*b* of the bracket 4 and prevented from axial movement by a snap ring 30. A U-shape support 33 having a pair of spaced arms 33*a* is secured to the housing 2*a* by fastening screws 32 as shown in FIG. 2, and supports a transverse shaft 31. On the transverse shaft 31 between the two arms 33*a* of the frame 33, a double-arm lever 35 is mounted by means of a pin 34 inserted into the wall 35*a* of the lever 35 and into a hole 31*a* of the shaft 31, and another double-arm lever 37 is turnably mounted on the shaft 3' and is prevented from axial displacement by a washer 36 and the right side arm 33*a* of the frame 33. These levers 35, 37 are normally biased by the respective springs 38 in the clockwise direction. The shaft 31 has a part protruding beyond the right side arm 33*a* of the frame 33 and turnably supports thereon another double-arm lever 39 and a frame 41 which is secured to the shaft 31 by a fastening screw 40, the arm 41*b* of the frame 41 being positioned inside of the arm 39*d* of the lever 39. Therefore, an abutment 37*c* provided at the arm 37*b* of lever is designed to engage an end 39*c* of the arm 39*b* of lever 39, and an abutment 41*d* provided at the lower end of the frame 41 is designed to engage the lower end 39*e* formed at the arm 39*d* of the lever 39.

An operating button 42 for controlling the cycle stitching mechanism and an operating button 44 for controlling the machine stopping mechanism are provided on the front face of the sewing machine as shown in FIG. 1. The operating button 42 is connected to the two arms 35*b* of the lever 35 by a pin 43, and the operating button 44 is connected to the two arms 37*b* of the lever 37 by a pin 45.

A transmission rod 46 is at one end connected to a pin 47 provided at an upper extended end of the double-arm lever 39 by a snap ring 49, and is at the other end thereof connected to a pin 48 provided at the upper end of the stop plate 13 by a snap ring 49. Another transmission rod 50 is at one end connected to a pin 51 provided at an upper extended end of the frame 41 by a snap ring 53 and is at the other end thereof connected to a pin 52 provided at the lower arm 28*b* of the frame by a snap ring 30. A tension spring 54 is at one end connected to the pin 51 of the frame 41 and is at the other end connected to a hole 50*a* of the transmission rod to normally bias the latter toward the former.

Figure 3:
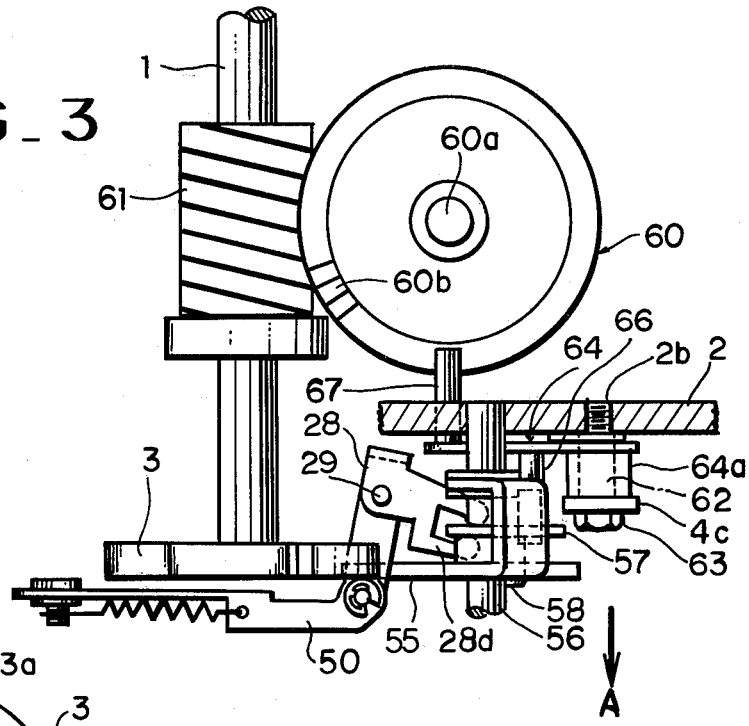
FIG. 3 is a plan view of cycle stitch control part of the invention.

In reference to FIGS. 2–4, the aforementioned stop pawl 55 has a base 55*a* and a sector part 55*b* which is provided with an opening 55*c*, a peripheral cutout 55*d* and a pawl end 55*e*. The stop pawl 55 is at the base 55*a* turnably mounted on a shaft 56 secured to the housing 2 and is prevented from axial displacement by a pair of snap rings. An arm 57 is turnable on the shaft 56 and is slidably axially of the shaft 56 within the base 55*a* of the stop pawl 55. As shown in FIG. 3, the arm 57 is engaged by a forked end 28*d* at the upper arm 28*c* of the frame 28. The arm 57 has a pin 58 operated to be inserted into or drawn out of the opening 55*c* of the stop pawl 55. The cutout 55*d* of the stop pawl 55 is normally engaged by a pin 59 provided at the upper end of the releasing lever 8, and the end 55*e* of the stop pawl 55 is operated to engage the stop cam 3.

A cycle stitch control cam 60 is mounted on a vertical shaft 60*a* and is rotated at a reduced speed, namely one complete revolution during 6 revolutions of the upper drive shaft 1, by a speed reduction gear mechanism including a worm 61 fixedly mounted on the shaft 1. The cycle stitch control cam 60 is arranged coaxially with a plurality of pattern cams (not shown) on the vertical shaft 60*a*, and has a notch 60*b* formed on the upper face adjacent to the outer periphery thereof as shown in FIG. 3.

A pivot pin 62 is at one end inserted into a hole 2*b* of the housing 2 and is at the other end inserted into a hole 4*c* provided at the upper end of the bracket 4 and is fixed by a nut 63. A lever 64 is at one end 64*a* thereof turnably mounted on the pivot pin 62, and has a laterally extended pin 66 provided on one side thereof and another laterally extended pin 67 provided on the other side thereof. The lever 64 is normally biased in the counterclockwise direction by a torsion spring 65 as shown in FIG. 2. The pin 66 of the lever 64 engages a groove 57*a* formed on the arm 67. The other pin 67 of the lever 64 is normally pressed against the cycle stitching cam 60 by the action of torsion spring 65.

Figure 5:
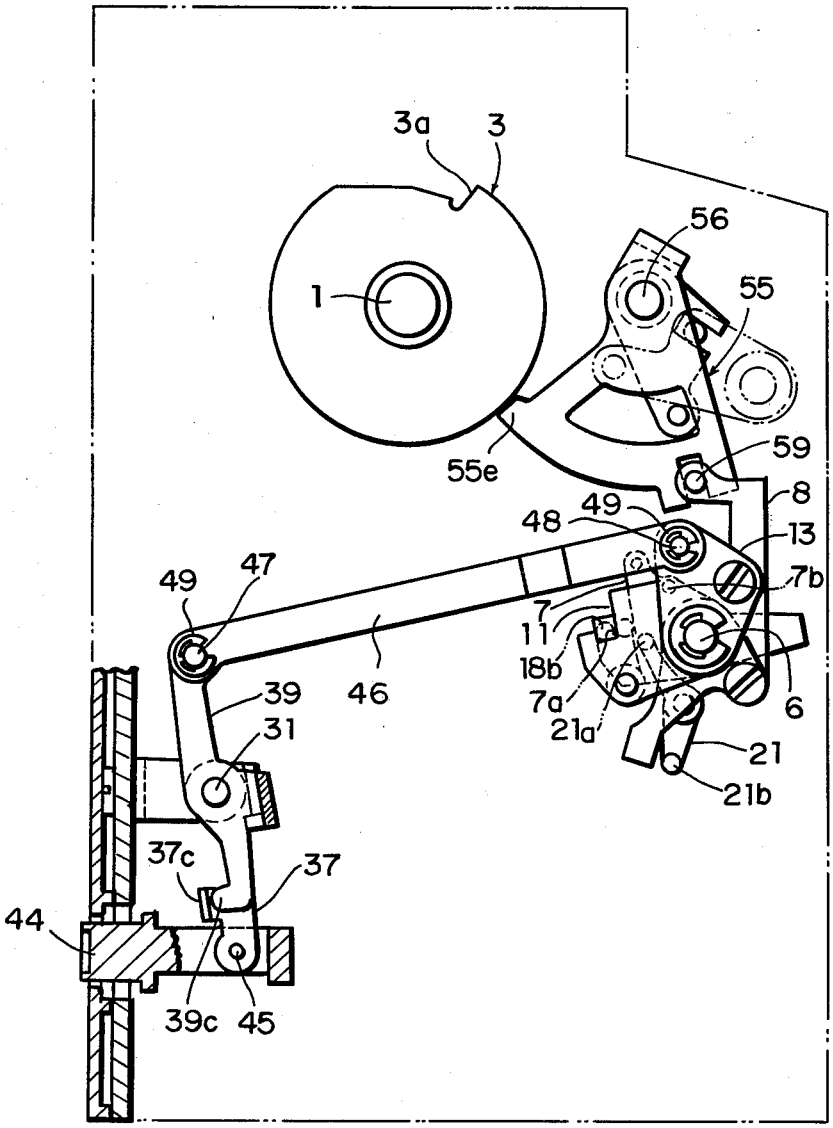
FIGS. 5 and 6 are side elevational operation explanatory views of stop mechanism of the invention taken from the right side of FIG. 1, FIGS. 7–10 are operation explanatory views of the mechanism of the invention.

With the above mentioned structure of the invention, the operation is as follows; FIG. 2 shows a condition of the mechanism in which the cycle stitch control button 42 and the stitch stop control button 44 are not operated. Now with reference to FIGS. 4 and 5, if the button 44 is pushed, the double-arm lever 37 is turned around the shaft 31 against the action of the spring 38 in the counterclockwise direction. Then the abutment 37*c* of the double-arm lever 37 turns the double-arm lever 39 in the counterclockwise direction. The connecting rod 46 is, therefore, axially displaced in the leftward direction. As a result, the stop lever 11 is turned in the counterclockwise direction against the action of spring 16 around the pin 6 of bracket 4, since the rod 46 is at one end connected to the pin 48 of the stop plate 13 which is secured to the stop lever 11 by the screw 12. The operating pawl 18 is, therefore, displaced in the same direction, since the pawl 18 is mounted on the pin 19 of the lever 11 and has the projection 18*b* pressed against the shoulder 11*c* of the lever 11 and against the step 7*a* of the switch operating plate 7 by the spring 20. The switch operating plate 7 is, therefore, turned in the counterclockwise direction against the action of spring 15. As a result, the lateral projection 7*b* of the switch operating plate 7 acts on the actuator 27 of the microswitch 26 to make the same ON. Thus a machine motor is driven through a control circuit, not shown, and the upper drive shaft 1 is rotated in the counterclockwise direction.

Figure 6:
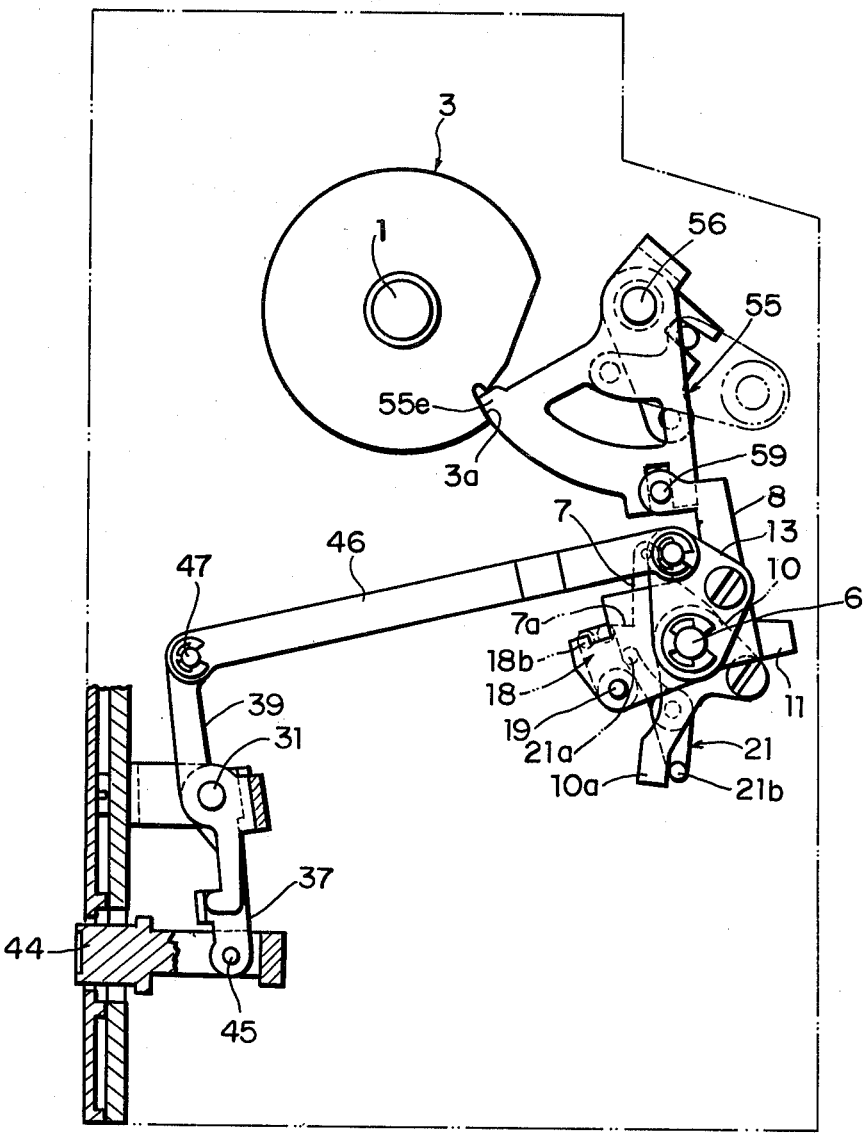

As the upper drive shaft 1 is rotated in the counterclockwise direction, the stop cam 3 is rotated together in the same direction. When the abutment 3*a* of the stop cam 3 comes to engage the end 55*e* of the stop pawl 55, as shown in FIG. 6, the stop pawl 55 is slightly turned in the clockwise direction, and therefore the releasing lever 8 is turned in the counterclockwise direction around the support pin 6 of the bracket 4. As a result, the the leg 10*a* of adjusting plate 10 secured to the releasing lever 8 presses the lower end 21*b* of releasing pawl 21. Then the releasing pawl 21 is turned in the counterclockwise direction, and the upper end 21*a* of pawl 21 turns the operating pawl 18 in the counterclockwise direction against the action of spring 20 around the pin 19 of the lever 11. The upper projection 18*b* of the operating pawl 18 is, therefore, disengaged from the step 7*a* of the switch operating plate 7. Then the switch operating plate 7 is turned back in the clockwise direction by the action of spring 15, and the lateral projection 7*b* is disengaged from the actuator 27 of microswitch 26. Thus the microswitch 26 is turned to OFF to stop the machine drive motor, and the upper drive shaft 1 is stopped at a predetermined angular position thereof corresponding to the upper dead point or the lower dead point of the needle at which the needle is detained, since the upper drive shaft 1 is disconnected from the machine motor by a timingly operating clutch mechanism (not shown). Thus the intermittent stitches are produced by repeatedly pushing and releasing the control button 44.

Figure 7:
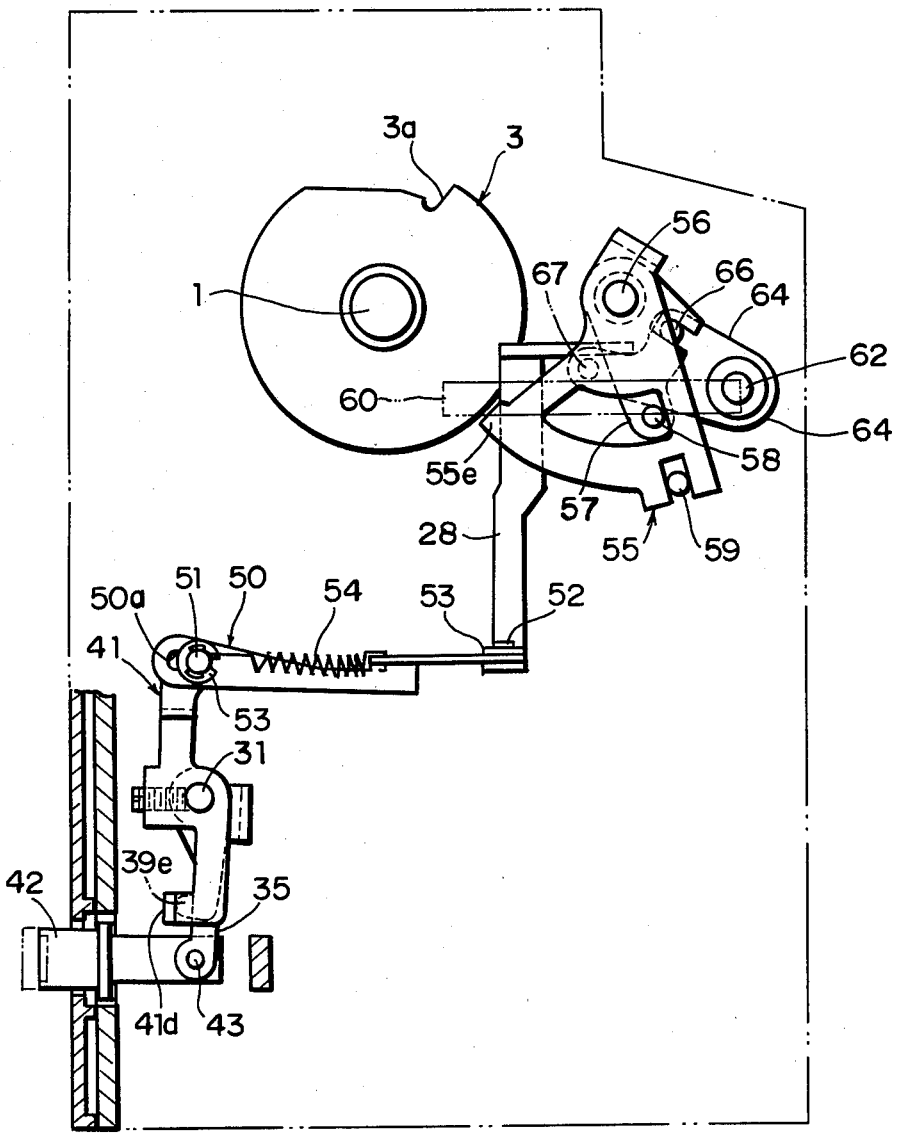

Now with reference to FIGS. 4 and 7, if the cycle stitch control button 42 is pushed and comes to the position as shown by a solid line from the inoperative position as shown by an imaginary line, the double-arm lever 35 and the support shaft 31 are turned in the counterclockwise direction against the action of spring 38. The frame 41, which is secured to the shaft 31, is therefore turned in the counterclockwise direction. The frame 28 is turned in the clockwise direction by way of the connecting rod 50, and then the arm 57 is displaced along the shaft 56 toward the sector part 55*b* of stop pawl 55 by the upper arm 28*c* of the frame until the pin 58 of the arm 57 is inserted into the opening 55*c* of the pawl 55 to maintain the end 55*e* of the pawl 55 in a position spaced from the stop cam 3.

Figure 9:
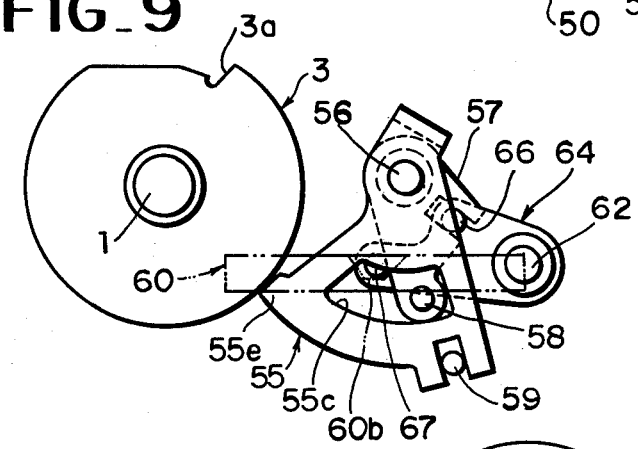
Figure 10:
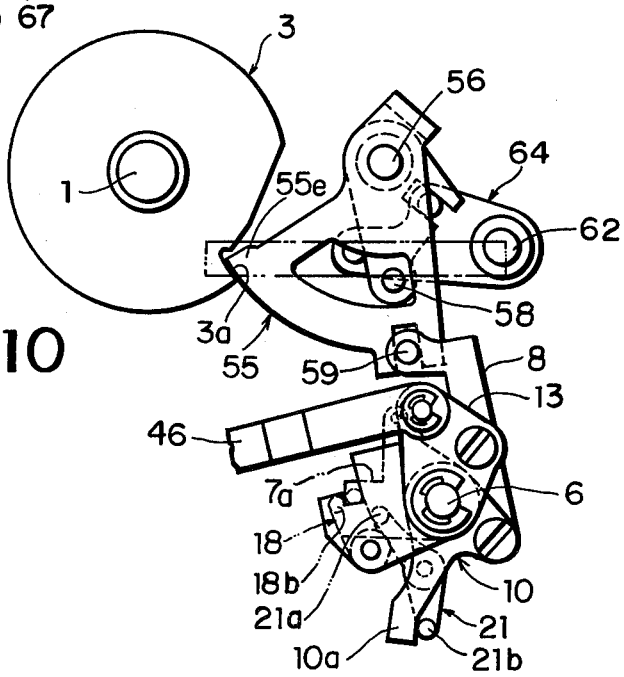
Figure 8:
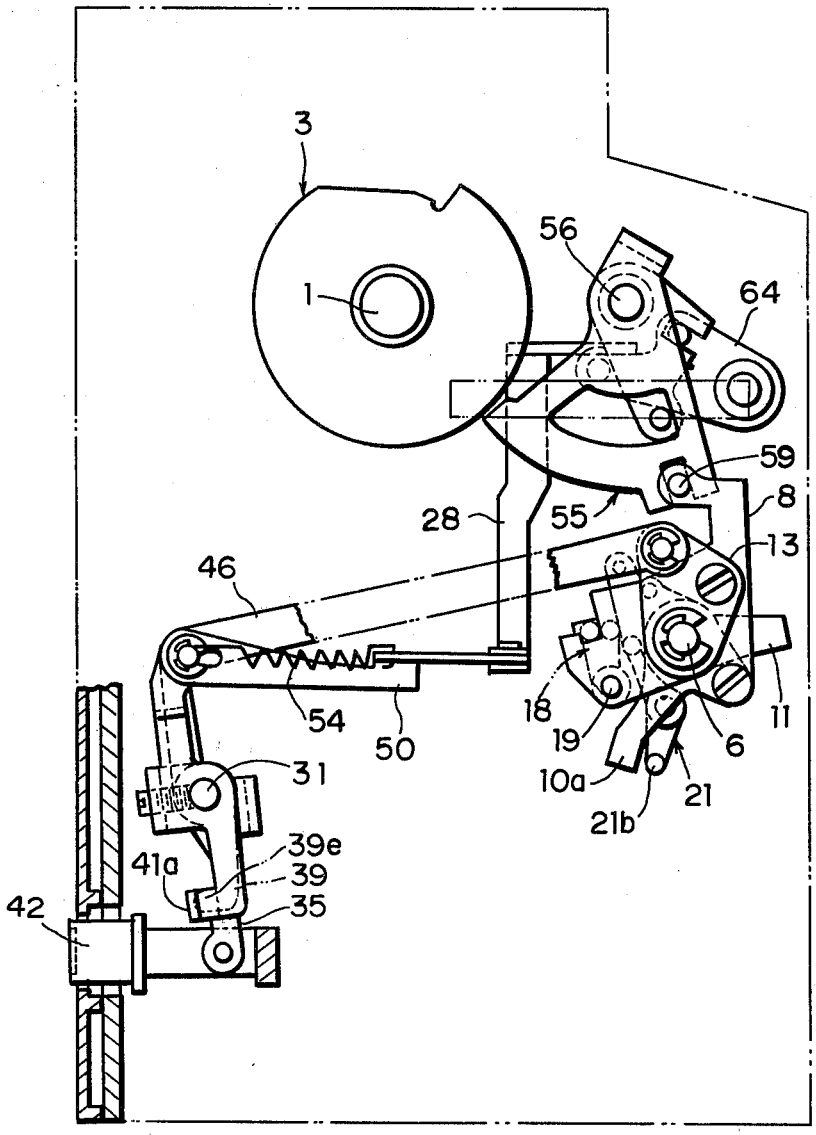

As the button 42 is pushed further as shown in FIG. 8, the abutment 41*d* of the frame 41 turns the double-arm lever 39 in the counterclockwise direction around the shaft 31. As result, the microswitch 26 is turned to ON in the manner as is mentioned hereinbefore, and the machine motor is driven to rotate the upper drive shaft 1 in the counterclockwise direction, and therefore, the cycle stitch control cam 60 is rotated at a reduced speed by way of the worm 61 secured to the upper drive shaft 1. When the notch 60*b* of the cycle stitch control cam 60 comes to the pin 67 of the lever 64, the lever 64 is turned in the counterclockwise direction by the action of spring 65, and the arm 57 is turned in the clockwise direction by the pin 66 of the lever 64. Therefore the pin 58 is turned in the same direction to allow the stop pawl 55 to engage the stop cam 3 due to the action of spring 17 as shown in FIG. 9. At the same time, the abutment 3*a* of the stop cam 3 engages the end 55*e* of the stop pawl 55 to turn the latter slightly in the counterclockwise direction as shown in FIG. 10. The releasing lever 8 is, therefore, turned in the counterclockwise direction, and as a result, the microswitch 26 is turned to OFF to stop the machine drive motor in the manner as mentioned thereinbefore. Then the upper drive shaft 1 is disconnected from the machine drive motor by the clutch mechanism, and is stopped at a predetermined angular position, thereby to stop the needle at the predetermined position thereof.

If the notch 60*b* of the cycle stitch control cam 60 is not in engagement with the pin 67 of the lever 64 at the time of starting the sewing machine, the machine operator may drive the sewing machine without stitching the fabric until the notch 60*b* comes to engage the pin 67.

It will be understood that each of the elements described above, or two or more together, may also find a useful application in other types of constructions differing from the types described above.

While the invention has been illustrated and described as embodied in a sewing machine, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A sewing machine, comprising an upper drive shaft (1) rotated to vertically reciprocate a needle to penetrate a fabric to be sewn for producing stitches thereon; a machine drive motor energized by operation of a microswitch (26) to rotate the upper drive shaft; a stop cam (3) secured to the upper drive shaft for rotation therewith: a blocking element (55) movable between an inoperative position in which the blocking element (55) is located out of the rotation path of the stop cam (3) and an operative position in which the blocking element (55) is located in the rotation path of the stop cam (3) to block the latter; a clutch mechanism normally connecting the upper drive shaft (1) to the machine drive motor and being operated to disconnect the upper drive shaft from the machine drive motor when the blocking element blocks the rotation of the stopper cam; a plurality of pattern cams rotated by the upper drive shaft (1) at a predetermined speed and being selectively connected to the needle to control the lateral movement thereof; cycle stitch control cam means (60) rotated by the upper drive shaft (1) at the same speed with the pattern cams; control means (64) cooperating with the cycle stitch control cam means (60) and moved by the latter between a first position for maintaining the blocking element (55) in the inoperative position and a second position for displacing the blocking element into the operative position at a predetermined angular position of the cycle stitch control cam means (60), said control means (64) including actuating means (57) which is moved in association with the control means and is movable between an inoperative position in which said actuating means (57) disconnects said control means (60) from the blocking means (55) and an operative position in which said actuating means (57) connects said control means to the blocking means (55); operating means (42, 35, 41, 50, 28) manually operated to move the actuating means (57) between the inoperative position and the operative position; switch operating means (39, 46, 13, 11, 18, 7) operated in association with the operating means to turn on the microswitch (26) when said actuating means (57) is moved to the operative position by the operating means; and releasing means (8, 10, 21) operated in association with the blocking element (55), when the blocking element blocks the rotation of the stop cam (3), to release said switch operating means (7) to thereby turn off the microswitch (26).

* * * * *